US007273418B2

(12) United States Patent
Gilbert et al.

(10) Patent No.: US 7,273,418 B2
(45) Date of Patent: Sep. 25, 2007

(54) IRON-TYPE GOLF CLUBS

(75) Inventors: Peter J. Gilbert, Carlsbad, CA (US); Bruce R. Pettibone, Carlsbad, CA (US); Michael Scott Burnett, Carlsbad, CA (US); Christopher R. Kays, San Marcos, CA (US); Tomas Diaz, Winchester, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 11/193,686

(22) Filed: Jul. 29, 2005

(65) Prior Publication Data

US 2006/0234808 A1 Oct. 19, 2006

Related U.S. Application Data

(63) Continuation-in-part of application No. 11/105,631, filed on Apr. 14, 2005, now Pat. No. 7,186,187.

(51) Int. Cl.
*A63B 53/04* (2006.01)

(52) U.S. Cl. ..... 473/290; 473/330; 473/332; 473/350

(58) Field of Classification Search ..... 473/330–331, 473/332, 290–291, 350
See application file for complete search history.

(56) References Cited

U.S. PATENT DOCUMENTS 4,420,156 A 12/1983 Campau
4,754,971 A * 7/1988 Kobayashi ..... 473/290
4,928,972 A 5/1990 Nakanishi et al.
5,388,826 A * 2/1995 Sherwood ..... 473/291
5,480,145 A 1/1996 Sherwood
5,547,426 A 8/1996 Wood
5,591,092 A 1/1997 Gilbert
5,967,903 A 10/1999 Cheng
5,976,029 A 11/1999 Sherwood
6,045,456 A 4/2000 Best et al.
6,196,934 B1 3/2001 Sherwood
6,290,607 B1 9/2001 Gilbert et al.
D473,606 S 4/2003 Mickelson et al.
6,547,675 B2 4/2003 Sherwood
6,605,007 B1 8/2003 Bissonnette et al.
6,830,519 B2 * 12/2004 Reed et al. ..... 473/290
6,863,621 B2 3/2005 Sherwood
2004/0214654 A1 * 10/2004 Pelz ..... 473/287

OTHER PUBLICATIONS

Maltby, Roger; Golf Club Design, Fitting, Alteration and Repair: The Principles and Procedures; 2nd Edition; May 1982, pp. 422, 444, 446, 449, 449; Ralph Maltby Enterprises, Inc., Newark OH.

* cited by examiner

*Primary Examiner*—Stephen Blau
(74) *Attorney, Agent, or Firm*—Mandi B. Milbank

(57) ABSTRACT

A set of iron-type golf clubs includes long irons with channel back configurations and short irons with cavity back configurations. The rear face configurations transition from channel backs through to pure cavity backs for increased performance continuum for the set. Additional design parameters for the set may also be systematically varied through the set, such as groove type and depth, loft angle, cavity volume, hitting face roughness, and sole width. At least one of the clubs of the set includes a sandwich-type construction for the hitting face having a dampening element disposed between a hitting face insert and a lightweight reinforcing core. In one embodiment, at least one club head is oversized.

5 Claims, 4 Drawing Sheets

IRON-TYPE GOLF CLUBS

CROSS-REFERENCE TO RELATED APPLICATION

The present application is a continuation-in-part of U.S. patent application Ser. No. 11/105,631 filed on Apr. 14, 2005, now U.S. Pat No. 7,186,187 the disclosure of which is incorporated herein by reference in its entirety.

FIELD OF THE INVENTION

This invention generally relates to golf clubs, and, more particularly, to iron clubs.

BACKGROUND OF THE INVENTION

Individual iron club heads in a set typically increase progressively in face surface area and weight as the clubs progress from the long irons to the short irons and wedges. Therefore, the club heads of the long irons have a smaller face surface area than the short irons and are typically more difficult for the average golfer to hit consistently well. For conventional club heads, this arises at least in part due to the smaller sweet spot of the corresponding smaller face surface area.

To help the average golfer consistently hit the sweet spot of a club head, many golf clubs are available with cavity back constructions for increased perimeter weighting. Perimeter weighting also provide the club head with higher rotational moment of inertia about its center of gravity. Club heads with higher moment of inertia have a lower tendency to rotate caused by off-center hits. Another recent trend has been to increase the overall size of the club heads. Each of these features increases the size of the sweet spot, and therefore makes it more likely that a shot hit slightly off-center still makes contact with the sweet spot and flies farther and straighter. One challenge for the golf club designer when maximizing the size of the club head is to maintain a desirable and effective overall weight of the golf club. For example, if the club head of a three iron is increased in size and weight, the club may become more difficult for the average golfer to swing properly.

In general, to increase the sweet spot, the center of gravity of these clubs is moved toward the bottom and back of the club head. This permits an average golfer to launch the ball up in the air faster and hit the ball farther. In addition, the moment of inertia of the club head is increased to minimize the distance and accuracy penalties associated with off-center hits. In order to move the weight down and back without increasing the overall weight of the club head, material or mass is taken from one area of the club head and moved to another. One solution has been to take material from the face of the club, creating a thin club face. Examples of this type of arrangement can be found in U.S. Pat. Nos. 4,928,972, 5,967,903 and 6,045,456.

However, for a set of irons, the performance characteristics desirable for the long irons generally differ from that of the short irons. For example, the long irons are more difficult to hit accurately, even for professionals, so having long irons with larger sweet spots is desirable. Similarly, short irons are generally easier to hit accurately, so the size of the sweet spot is not as much of a concern. However, greater workability of the short irons is often demanded.

Currently, in order to produce the best overall game results, golfers may have to buy their clubs individually, which results in greater play variation through the set than is desirable. Therefore, there exists a need in the art for a set of clubs where the individual clubs in the set are designed to yield an overall maximized performance continuum for the set.

SUMMARY OF THE INVENTION

In accordance with one aspect of the present invention, a set of iron-type golf clubs comprises at least one long iron and at least one short iron. The irons have a hitting face and a substantially cavity back rear face, wherein a cavity volume for each club in the set varies systematically from the at least one long iron to the at least one short iron, and wherein a hitting face area for each club in the set is constant.

In accordance with another aspect of the present invention, a set of iron-type golf clubs includes at least three clubs, wherein a face thickness (FT) for each club is described by the equation $$FT=\alpha*(0.00125\ \text{in/deg}*LA+0.06\ \text{in})$$

where LA is a loft angle in degrees and $\alpha$ ranges from about 0.8 to about 1.2

In accordance with another aspect of the present invention, a set of iron-type golf clubs includes at least three clubs, wherein a top line width (TLW) for each club is described by the equation $$TLW=\alpha*(-0.0034\ \text{in/deg}*LA+0.41\ \text{in})$$

wherein LA is a loft angle measured in degrees and $\alpha$ ranges from about 0.85 to about 1.15.

According to another aspect of the present invention, a set of iron-type golf clubs includes at least three clubs, wherein a groove depth (GD) for each club is described by the equation $$GD=\alpha*(0.0003\ \text{in/deg}*LA+0.02\ \text{in})$$

wherein LA is a loft angle measured in degrees and $\alpha$ ranges from about 0.85 to about 1.15.

In accordance with yet another aspect of the present invention, a set of iron-type golf clubs includes at least three clubs, wherein a sole width (SW) for each club is described by the equation $$SW=\alpha*(-0.0044\ \text{in/deg}*LA+0.87\ \text{in})$$

wherein LA is a loft angle measured in degrees and $\alpha$ ranges from about 0.9 to about 1.1.

According to yet another aspect of the present invention, a set of iron-type golf clubs comprising at least three clubs, wherein a cavity volume (CV) for each club is described by the equation $$CV=\alpha*(-0.0356\ \text{in}^3/\text{deg}*LA+2.11\ \text{in}^3)$$

wherein LA is a loft angle measured in degrees and $\alpha$ ranges from about 0.8 to about 1.2.

In accordance with another aspect of the present invention, a set of iron-type golf clubs comprising at least three clubs, wherein a surface roughness (SR) for each club is described by the equation $$SR=\alpha*(3.75\ \mu\text{in/deg}*LA-7.5\ \mu\text{in})$$

wherein LA is a loft angle measured in degrees and $\alpha$ ranges from about 0.8 to about 1.2.

According to another aspect of the present invention, an iron-type golf club head comprises a hosel and a body attached to the hosel at a loft angle. The body includes a hitting face and a rear flange having a channel formed therewithin. A hitting face insert is disposed in the hitting face. A dampening element is disposed between the hitting face insert and a core configured to be inserted at least partially within the channel and in contact with the hitting face insert.

BRIEF DESCRIPTION OF THE DRAWINGS

In the accompanying drawings, which form a part of the specification and are to be read in conjunction therewith and in which like reference numerals are used to indicate like parts in the various views.

DETAILED DESCRIPTION OF THE PREFERRED EMBODIMENTS

Figure 1:
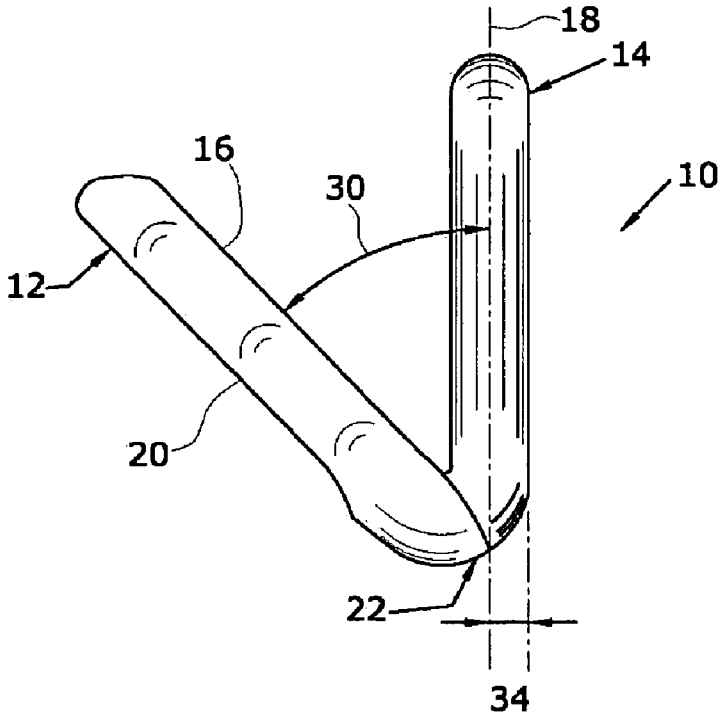
FIG. 1 is a toe view of a club head.

As illustrated in the accompanying drawings and discussed in detail below, the present invention is directed to a set of iron-type golf clubs, wherein the clubs are a blended set of cavity back-type clubs, muscle back-type clubs, and, preferably, transitional cavity-muscle-type clubs. For the purposes of illustration, FIG. 1 shows a reference iron-type club head 10 for defining various design parameters for the present invention. These design parameters for the clubs are chosen such that the parameters progress through the set from the long irons to the short irons in a pre-determined fashion. Club head 10 is attached to a shaft (not shown) in any manner known in the art.

Club head 10 includes, generally, a body 12 and a hosel 14. Body 12 includes a striking or hitting face 16 and a rear face 20. Body 12 is attached to hosel 14 at an angle, such that a loft angle 30 is defined between a hosel center line 18 and hitting face 16. Further, the relative configuration of body 12 and hosel 14 results in an offset 34 between the leading edge 22 of the base of the hitting face and the forward-most point 15 of the hosel.

In typical sets of golf clubs, the area of hitting face 16, the heel-to-toe length of body 12, loft angle 30, and offset 34 vary from club to club within the set. For example, long irons, such as a 2-, 3-, or 4-iron using conventional numbering, typically include relatively long shafts, relatively small areas for hitting face 16, and relatively low loft angles 30. Similarly, short irons, such as an 8- or 9-iron or the Pitching Wedge using conventional numbering, typically include relatively short shafts, relatively larger areas for hitting face 16, and relatively high loft angles 30. In the present invention, these parameters are particularly chosen to maximize the performance of each club for its intended use. Further, these parameters progress in a predetermined fashion through the set.

Similarly, in many typical sets, loft angle 30 increases as the set progresses from the long irons (2, 3, 4) to the short irons (8, 9, PW). For the long irons, loft angle 30 varies linearly: approximately a three-degree increase. Similarly, for the short irons, loft angle 30 varies linearly: approximately a four-degree increase. Other variations of loft angle 30 are within the scope of the present invention, and the choice of loft angle 30 may depend upon various other design considerations, such as the choice of material and aesthetics.

One such parameter is the configuration of rear face 20. In typical sets of golf clubs, rear face 20 has either a "cavity back" configuration, i.e., a substantial portion of the mass of the club head is positioned on the back side around the perimeter 32 of the club head, or a "muscle back" configuration, where the mass of the club is relatively evenly distributed along the heel-to-toe length of body 12. Cavity back clubs tend to have larger sweet spots, lower centers of gravity, and higher inertia. In other words, cavity back clubs are easier to produce true hits. In long irons, the sweet spot can be difficult to hit accurately. Therefore, it is desirable for the long irons to have cavity back configurations. Another design for rear face 20 is a "channel back" which is similar to a cavity back with an undercut flange positioned near the sole to move the center of gravity rearward. Muscle back clubs tend to have relatively small sweet spots, higher centers of gravity, and lower inertia about shaft axis 18. If struck correctly, muscle back clubs often yield greater overall performance or workability due to the mass (or muscle) behind the sweet spot, but are more difficult to hit accurately by the average golfer due to the smaller sweet spot. As short irons tend to be easier to hit true for the average golfer, but workability can be lacking, it is desirable for the short irons to have muscle back configurations.

According to one aspect of the present invention, the performance continuum of the set is maximized by gradually transforming the configuration of rear face 20 from a predominantly channel back in the long irons to a muscle back in the short irons. Additionally, a vibration dampening insert is incorporated into the channel back clubs. Further, the performance continuum is enhanced by having oversized club heads in the long irons, i.e., clubs heads that are larger or substantially larger than standard or traditional club heads, and gradually transitioning to mid-sized or standard-sized club heads in the short irons. In this manner, the long irons are relatively easier to hit accurately while the workability of the short irons is maintained.

Parent U.S. application Ser. No. 11/105,631, previously incorporated by reference, shows one embodiment of a set having a performance continuum. In that embodiment, the long irons have a cavity back configuration that is systematically transformed into a muscle back configuration in the short irons. In other words, as the clubs advance through the set, the configuration of the rear face begins as a pure cavity back in the longest iron, such as a 2-iron, develops muscle back traits in the mid-irons, such as having less mass on the perimeter of the club head, and finally becomes a pure muscle back configuration at or around the 8-iron. Table 1 details exemplary face area, exemplary offset, exemplary body length, and exemplary loft angle of the set in the '631 application as the set progresses from the long irons to the short irons.

TABLE 1

Exemplary Club Parameters from the '631 Application

| Iron Number | Loft Angle (degrees) | Cavity Volume ($in^3$) | Face Area ($in^2$) | Offset (in) | Top Line Width (in) | Center Sole Width (in) |
|---|---|---|---|---|---|---|
| 2 | 19 | 8.10 | 4.88 | 0.15 | 0.245 | 0.720 |
| 3 | 22 | 7.52 | 4.92 | 0.14 | 0.237 | 0.705 |
| 4 | 25 | 6.59 | 4.96 | 0.13 | 0.229 | 0.690 |
| 5 | 28 | 5.61 | 4.99 | 0.121 | 0.221 | 0.675 |
| 6 | 32 | 4.49 | 5.03 | 0.11 | 0.213 | 0.660 |
| 7 | 36 | 3.62 | 5.06 | 0.099 | 0.205 | 0.645 |
| 8 | 40 | NA | 5.11 | 0.09 | 0.197 | 0.630 |
| 9 | 44 | NA | 5.17 | 0.084 | 0.189 | 0.615 |
| PW | 48 | NA | 5.23 | 0.08 | 0.181 | 0.600 |

This systematic transition from cavity back clubs in the long irons of the set through transitional cavity-muscle backs in the mid-range irons to pure muscle back clubs in the short irons allows for a smoother performance continuum for the set taken as a whole. The long irons are made easier to hit correctly due to the cavity back design, and the short irons have improved performance due to the muscle back design. As is known in the art, when the center of gravity is below and behind the geometric center of the hitting face, the club can launch the golf ball to higher trajectory and longer flight distance.

As will be understood by those in the art, the location of the center of gravity may be altered through the set by other means, such as by including a dense insert, as described in co-owned, co-pending application Ser. No. 10/911,422 filed on Aug. 8, 2004, the disclosure of which is incorporated herein by reference in its entirety, or by otherwise altering the thickness or materials of hitting face 16 as described in U.S. Pat. No. 6,605,007, the disclosure of which is incorporated herein by reference.

Rotational moment of inertia ("inertia") in golf clubs is well known in art, and is fully discussed in many references, including U.S. Pat. No. 4,420,156, which is incorporated herein by reference in its entirety. When the inertia is too low, the club head tends to rotate more from off-center hits. Higher inertia indicates higher rotational mass and less rotation from off-center hits, thereby allowing off-center hits to fly farther and closer to the intended path. Inertia is measured about a vertical axis going through the center of gravity of the club head ($I_{yy}$), and about a horizontal axis going through the center of gravity (CG) of the club head ($I_{xx}$). The tendency of the club head to rotate around the y-axis through the CG indicates the amount of rotation that an off-center hit away from the y-axis causes. Similarly, the tendency of the club head to rotate in the around the x-axis through the CG indicates the amount of rotation that an off-center hit away from the x-axis through the CG causes. Most off-center hits cause a tendency to rotate around both x and y axes. High $I_{xx}$ and $I_{yy}$ reduce the tendency to rotate and provide more forgiveness to off-center hits.

Inertia is also measured about the shaft axis ($I_{sa}$). First, the face of the club is set in the address position, then the face is squared and the loft angle and the lie angle are set before measurements are taken. Any golf ball hit has a tendency to cause the club head to rotate around the shaft axis. An off-center hit toward the toe would produce the highest tendency to rotate about the shaft axis, and an off-center hit toward the heel causes the lowest. High $I_{sa}$ reduces the tendency to rotate and provides more control of the hitting face.

Also, Table 2 shows how exemplary centers of gravity and moments of inertia of the bodies systematically increase through the set with the systematic transition of the exemplary set parameters as shown in Table 1. The center of gravity is measured from the ground while the club head is in the address position, which is the position in which a golfer places the club with the sole of the club on the ground prior to beginning a swing.

TABLE 2

Center of Gravity and Inertial Moments from the '631 Application

| Iron Number | CG from Ground (Inches) | Moment of Inertia ($I_{xx}$) | Moment of Inertia ($I_{yy}$) | Moment of Inertia ($I_{sa}$) |
|---|---|---|---|---|
| 2 | 17.00 | 46.5 | 211 | 453 |
| 3 | 17.20 | 47.0 | 211 | 464 |
| 4 | 17.40 | 48.7 | 211 | 477 |
| 5 | 17.60 | 49.0 | 214 | 498 |
| 6 | 17.80 | 50.0 | 217 | 511 |
| 7 | 18.00 | 51.5 | 221 | 529 |
| 8 | 18.20 | 60.4 | 225 | 534 |
| 9 | 18.40 | 64.0 | 231 | 545 |
| PW | 18.60 | 65.9 | 234 | 561 |

FIGS. 2-7 show another embodiment of a club set having a performance continuum through the set according to the present invention. Various design parameters of the club head of the set systematically vary in the progression through the set in order to provide a continuum of performance and aesthetics. In the embodiment shown in FIGS. 2-7, the club heads 1010, 1110, 1210 preferably progress from an oversized channel back in the long irons (shown in FIGS. 2-5), through a mid-sized channel back in the mid-irons (shown in FIG. 6), and finally to a standard-sized cavity back in the short irons (shown in FIG. 7). In another embodiment, all clubs of the set may be oversized, mid-sized, standard, or any combination thereof.

Figure 2:
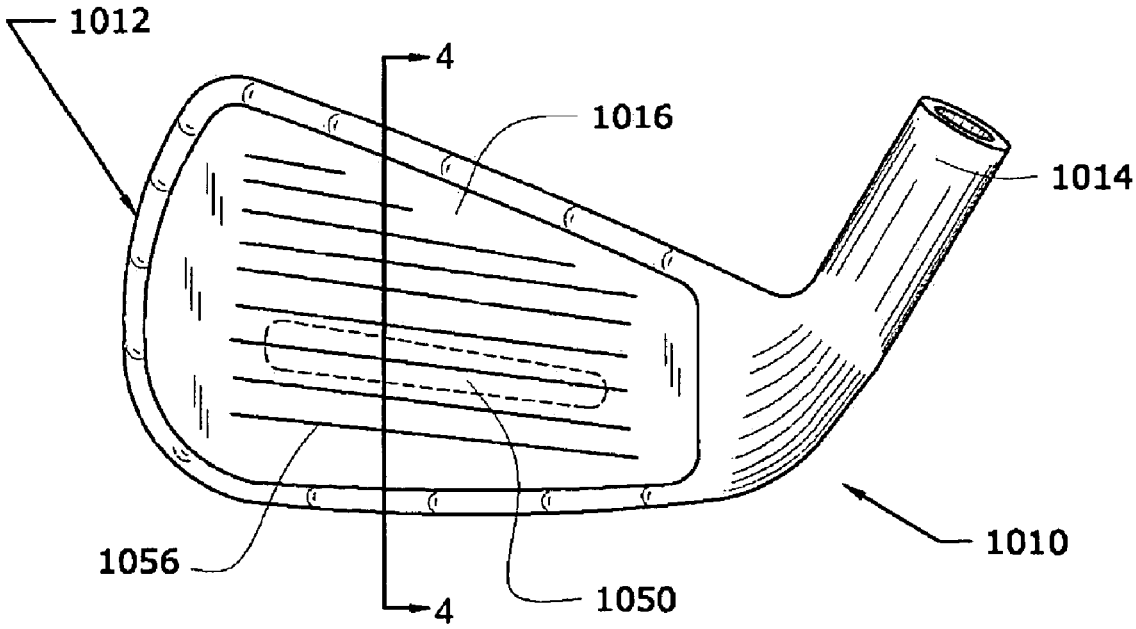
FIG. 2 is a front view of a club head having a vibration dampener.
Figure 3:
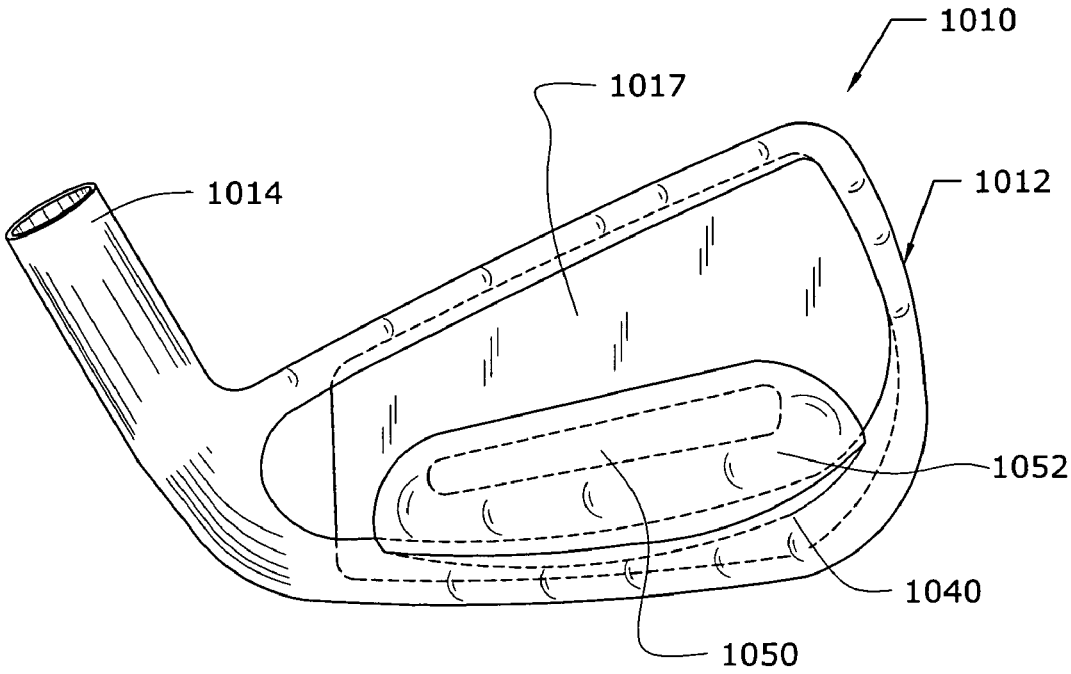
FIG. 3 is a rear view of the club head of FIG. 2.

FIGS. 2-5 show a club head 1010 of a long iron, preferably a 2-, 3-, or 4-iron using common numbering. FIG. 2 is a front view of a club head 1010 having a hosel 1014 connected to a body 1012 at a loft angle 1030. In the long irons, loft angle 1030 preferably ranges from about 18 degrees to about 27 degrees. Body 1012 includes a hitting face 1016 and a rear face 1020 shown in FIG. 3. The configuration of rear face 1020 as shown in FIG. 3 is preferably of the type known in the art as a "channel back", where a channel 1042 (shown in FIGS. 4 and 4*a*) is defined by a flange 1040 in the sole portion of club head 1010. As shown, a channel back is used with a cavity back design. Club head 1010 may be made from any material known in the art and by any method known in the art. Preferably, however, club head 1010 is forged from stainless steel and chrome plated. Further discussion of this and other manufacturing methods and appropriate materials may be found in co-owned, co-pending application Ser. No. 10/640,537 filed on Aug. 13, 2003, the disclosure of which is incorporated herein by reference.

Figure 4:
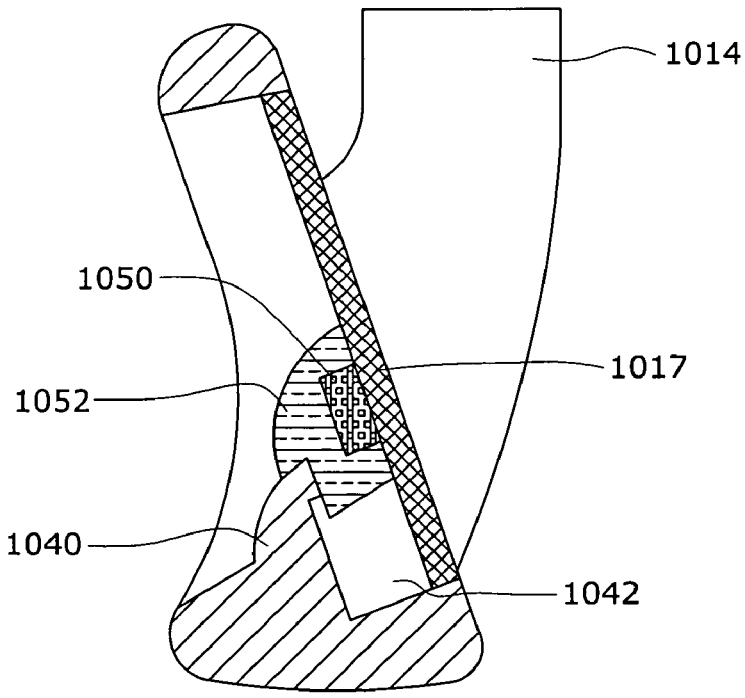
FIG. 4 is a cross-sectional view of the club head of FIG. 2 taken along line 4-4 thereof showing the vibration dampener.
Figure 4A:
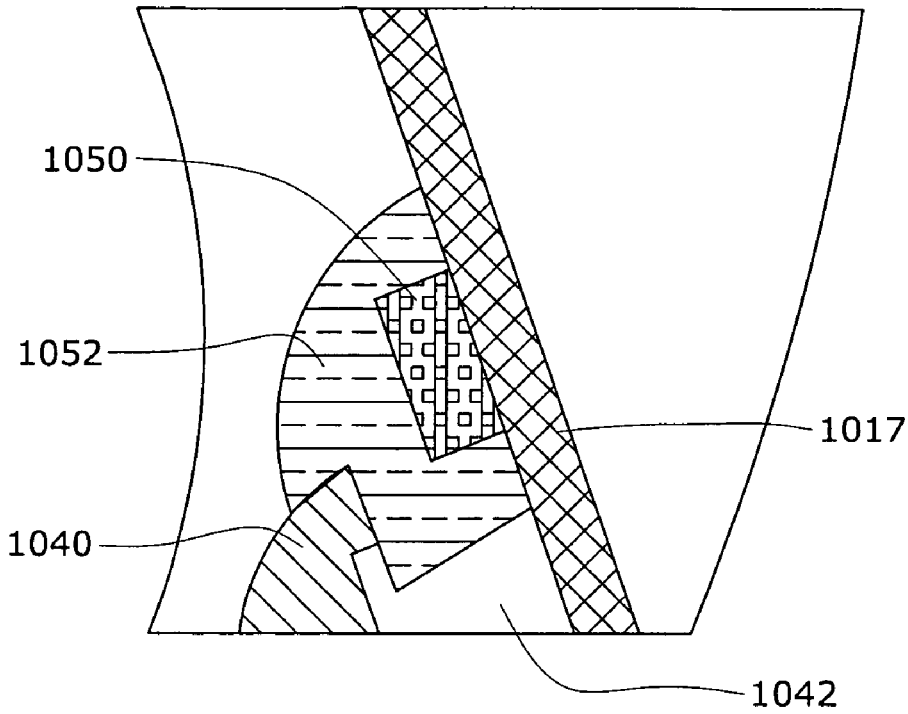
FIG. 4*a* is an enlarged cross-sectional view of the vibration dampener of FIG. 4.
Figure 5:
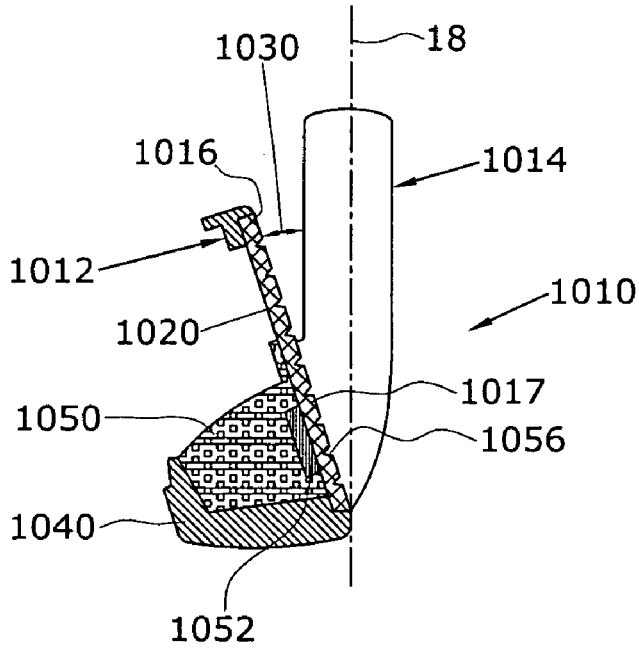
FIG. 5 shows a cross-sectional view of a long iron according to an embodiment of the present invention.

A shown in FIGS. 4, 4*a*, and 5, hitting face 1016 preferably has a sandwich-type construction that includes a hitting face insert 1017, a dampening element 1050, and a lightweight core 1052 for reinforcing hitting face insert 1017. Hitting face insert 1017 is preferably thin, so as to redistribute the weight of hitting face 1016 to flange 1040, and strong, so as to withstand the repeated impacts. This sandwich-type construction allows for hitting face insert 1017 to be very thin, as core 1052 reinforces the impact zone of 1017. As hitting face 1017 is thin, and, therefore, lighter than a conventional hitting face made of a thicker material, the center of gravity of club head 1010 is moved aft, which results in higher ball flight. Dampening element 1050 helps to improve the vibration characteristics of club head 1010.

Hitting face insert 1017 is preferably made from a low weight material having a density of less than about 5 g/cc and a hardness ranging from about 20 to about 60 on the Rockwell Hardness C scale (HRC). Appropriate materials include titanium, titanium alloys, plastic, urethane, and magnesium. More preferably, the hardness of hitting face insert 1017 is about 40 on the HRC. Hitting face insert 1017 is preferably sized to be press fit into a corresponding void in hitting face 1016 and secured therewithin using any method known in the art, such as an adhesive or welding. A front side of hitting face insert 1017 preferably includes surface textures, such as a roughened face and a succession of grooves 1056 (shown in FIGS. 2 and 5). Hitting face insert may be made by any method known in the art, such as by machining sheet metal, forging, casting, or the like.

As hitting face insert 1017 is thin, core 1052 is disposed behind hitting face insert 1017 to reinforce hitting face insert 1017. Core 1052 is preferably made from a lightweight material such as aluminum. Core 1052 is configured to be at least partially inserted into channel 1042, such as by press fitting, and is also preferably affixed within channel 1042 and to hitting face insert 1017, for example with an adhesive, such as epoxy.

Dampening element 1050 is disposed between hitting face insert 1017 and core 1052. Dampening element 1050 may be any type of resilient material known in the art for dampening vibrations such as rubber or urethane having a hardness of about 60 on the Rockwell Hardness A scale (HRA). Dampening element 1050 is preferably configured to be press fit into a void (not shown) formed in core 1052 and securing it therewithin with an adhesive such as epoxy. Preferably, dampening element 1050 is generally quadrilateral in shape, with the surface area of one of the faces of dampening element 1050 ranging from about 0.1 $in^2$ to about 2.5 $in^2$, and more preferably between about 0.15 $in^2$ and about 1.2 $in^2$. The thickness of dampening element 1050 preferably ranges from about 0.050 in to about 0.45 in, and is preferably about 0.1 in. As will be recognized by those in the art, the dimensions of dampening insert 1050 chosen for any particular club head will depend upon many factors, including the area of the hitting face and the material of the dampening element. Dampening element 1050 is preferably located behind hitting face insert 1017 at the point of most likely ball impact, such as about 0.75 in above the sole. Dampening element 1050 absorbs a portion of the shock of impact to reduce vibrations of the club for a better feel during play.

As will be apparent to those in the art, the use of this sandwich-type configuration to provide hitting face reinforcement and dampening is appropriate for use in any iron-type club. Additionally, dampening element 1050 and core 1052 may be used without hitting face insert 1017, i.e., placed directly behind a unitary piece hitting face 1016. However, as in the preferred set the club heads transition from channel back in the long irons to conventional cavity backs in the short irons, the use of the sandwich-type configuration with a hitting face insert 1017 is preferably confined to the long irons.

Figure 6:
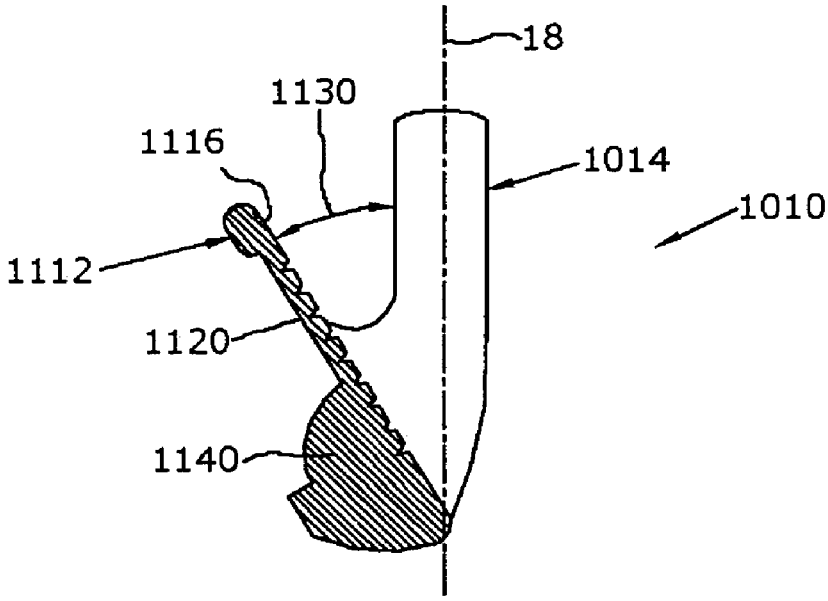
FIG. 6 shows a cross-sectional view of a mid iron according to the embodiment of FIG. 2.

A mid-iron club head 1110 design is shown in FIG. 6. In club head 1110, a hosel 1114 is attached to a body 1112 at a loft angle 1130. Loft angle 1130 preferably ranges from about 27 degrees to about 40 degrees, more preferably from about 29 degrees to about 37 degrees. Club head 1110 is preferably formed as a unitary piece from a material such as forged stainless steel. In other words, since the center of gravity may be higher in the mid-iron clubs, no light weight hitting face insert or sandwich-type construction is used. However, in another embodiment, hitting face 1116 may be thinned and a sandwich-type constriction may be used, although preferably no hitting face insert is provided. Preferably, in the mid-iron clubs of the set, the volumes of the rear cavities are less than those of the short irons, as the cavity volumes progress through the set to contribute to the performance continuum as discussed above.

Figure 7:
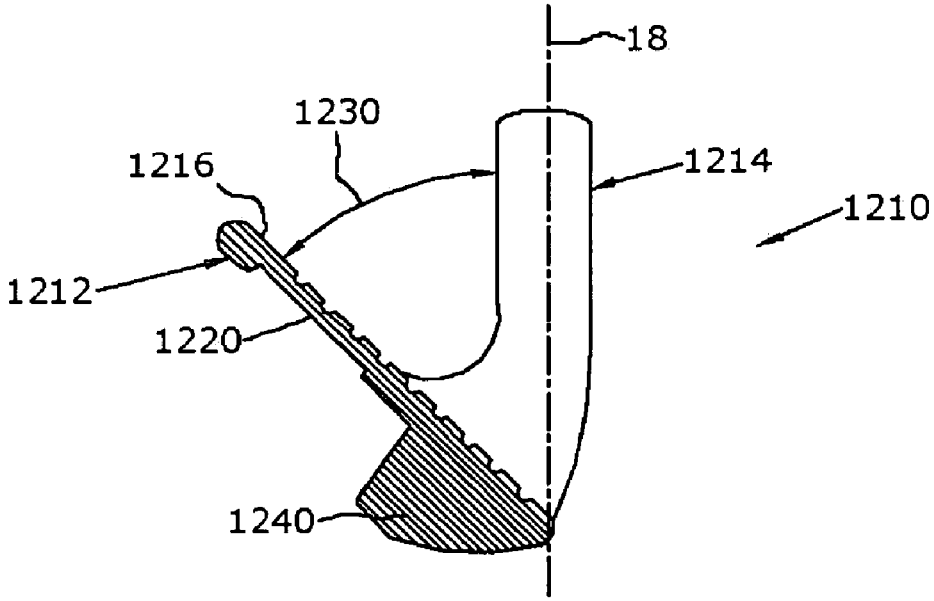
FIG. 7 shows a cross-sectional view of a short iron according to the embodiment of FIG. 2.

A short-iron club head 1210 design is shown in FIG. 7. In club head 1210, a hosel 1214 is attached to a body 1212 at a loft angle 1230. Loft angle 1230 preferably ranges from about 40 degrees to about 52 degrees, more preferably from about 41 degrees to about 50 degrees. Similar to club head 1110 discussed with respect to FIG. 6 above, club head 1210 is preferably formed as a unitary piece from a material such as forged stainless steel. Again, while a muscle back or a channel such as channel 1042 may be provided, preferably club head 1210 is a traditional cavity back design. Preferably, in the short irons, the volumes of the rear cavities are less than those of the mid-irons, as the cavity volumes progress through the set to contribute to the performance continuum as discussed above.

In this embodiment, the area of hitting face 1016, 1116, 1216 is preferably substantially constant through the set. However, in addition to varying the club head type through the set, other design parameters are also preferably systematically varied through the set to yield maximum performance results from the set, as shown in Table 3.

TABLE 3

Exemplary Club Parameters, Long Irons Having Sandwich Construction

| Parameter | 2-Iron | Pitching Wedge |
|---|---|---|
| Face Area (in2) | 5.6 | 5.6 |
| Face Thickness (in) | 0.080 | 0.120 |
| Face Hardness | HRC 50 | HRB 70 |
| Cavity Volume ($in^3$) | 1.47 | 0.33 |
| Top Line Width (in) | 0.350 | 0.242 |
| Hosel Length (in) | 2.2 | 2.7 |
| Grooves, depth (in) | 0.025 | 0.035 |
| Grooves, type | V | U |
| Sole, width (in) | 0.79 | 0.65 |

These design parameters are preferably varied approximately linearly through the set. For example, the face thickness (FT) of the clubs of the preferred set is established by the following linear equation:

$$FT=0.00125\ \text{in/deg}*LA+0.06\ \text{in} \qquad \text{Eq. 1}$$

where LA is the loft angle in degrees and FT is in inches. The design tolerance for this parameter is ±20%. Therefore, each club of the set has a face thickness that fits this equation, within the design tolerance. Another way to use this equation and account for the design tolerance is to multiply the result of the equation by a factor α that takes into the design tolerance. For example, Eq. 1 with factor α becomes:

$$FT=\alpha*(0.00125\ \text{in/deg}*LA+0.06\ \text{in}) \quad \text{Eq. 1}\alpha$$

where α ranges from about 0.8 to about 1.2 to account for a design tolerance of approximately ±20%.

Similar equations for the example design of Table 3 may be expressed for each design parameter shown in Table 3. The top line width (TLW) in inches expressed as a function of the LA in degrees is:

$$TLW=-0.0034\ \text{in/deg}*LA+0.41\ \text{in} \quad \text{Eq. 2}$$

The design tolerance for this parameter is ±15%, so α ranges from about 0.85 to about 1.15 for Eq. 2.

The depth of grooves 1056 (GD) in inches as expressed as a function of the LA in degrees is:

$$GD=0.0003\ \text{in/deg}*LA+0.02\ \text{in} \quad \text{Eq.3}$$

The design tolerance for this parameter is ±15%, so α ranges from about 0.85 to about 1.15 for Eq. 3.

The width of the sole (SW) in inches as expressed as a function of the LA in degrees is:

$$SW=-0.0044\ \text{in/deg}*LA+0.87\ \text{in} \quad \text{Eq. 4}$$

The design tolerance for this parameter is ±10%, so α ranges from about 0.9 to about 1.1 for Eq. 4.

The volume of the cavity (CV) on rear face 1020 in cubic inches expressed as a function of the LA in degrees is:

$$CV=-0.0356\ \text{in}^3/\text{deg}*LA+2.11\ \text{in}^3 \quad \text{Eq. 5}$$

The design tolerance for this parameter is ±20%, so α ranges from about 0.8 to about 1.2 for Eq. 5.

Groove geometry may be varied to affect spin performance, such as is discussed in U.S. Pat. No. 5,591,092, the disclosure of which is hereby incorporated by reference in its entirety. A front side of hitting face insert 1017 preferably includes surface textures, such as a roughened face and a succession of grooves 1056 (shown in FIGS. 2 and 5-7).

In the present invention, grooves 1056 are preferably V-shaped in cross-section in the long- and mid-irons, as shown in FIGS. 5 and 6, and U-shaped in cross-section in the short-irons, as shown in FIG. 7. The draft angle, commonly defined as the angle between an axis perpendicular to the hitting face and a sidewall of the groove, preferably ranges from about 35 degrees to about 3 degrees, and more preferably from about 35 degrees to about 20 degrees. Further, as discussed above, the depth of the grooves preferably vary through the set according to Eq. 3. Additionally, grooves 1056 preferably conform to USGA standard 4-1(a) and the additional specifications set forth in Appendix II, standard 1-5(c).

The design of the grooves and the roughness of the face texture are preferably systematically varied through the set, various design embodiments A-D for which are as shown in Table 4.

TABLE 4

Hitting Face Surface Textures

| | Design A | | Design B | | Design C | | Design D | |
|---|---|---|---|---|---|---|---|---|
| Iron | Groove Shape | RA, μin | Groove Shape | RA, μin | Groove Shape | RA, μin | Groove Draft Angle, deg | RA, μin |
| 2 | V | 75 | V | 50 | V | 60 | 35 | 60 |
| 3 | V | 75 | V | 50 | V | 75 | 31 | 75 |
| 4 | V | 75 | V | 50 | V | 90 | 27 | 90 |
| 5 | V | 75 | V | 100 | V | 105 | 23 | 105 |
| 6 | V | 75 | V | 100 | V | 120 | 19 | 120 |
| 7 | V | 75 | V | 100 | V | 135 | 15 | 135 |
| 8 | U | 180 | U | 180 | U | 150 | 11 | 150 |
| 9 | U | 180 | U | 180 | U | 165 | 7 | 165 |
| PW | U | 180 | U | 180 | U | 180 | 3 | 180 |

Similarly, the hitting face (1016, 1116, 1216) is roughened by any means known in the art, such as spin milling or fly cutting to finish the surface. Typically, the roughness of a surface is measured as a Roughness Average (RA), the deviation expressed in microinches (μin) measured normal to the center line, i.e., the location of the surface without any finishing texture. USGA standards limit the roughness of a hitting surface to fine milling or sandblasting, which gives an ultimate RA of about 180 μin±20 μin. Preferably, all club heads 1010, 1110, 1210 conform to the USGA standard. A more preferred hitting surface roughness design has a hitting face roughness of about 75 μin for the long- and mid-irons, and about 180 μin for the short irons. Alternatively, as shown in Table 4, the surface roughness can systematically increase through the set, with the smoothest surfaces in the long irons. This progression can be expressed by the following equation, where surface roughness (SR) is a function of loft angle (LA) in degrees:

$$SR=3.75\ \mu\text{in/deg}*LA-7.5\ \mu\text{in} \quad \text{Eq. 6}$$

The design tolerance for this parameter is ±20%, so α ranges from about 0.8 to about 1.2 for Eq. 6.

The surface roughness may be formed during manufacture of the face as a whole, such as by casting or forging with the texture, or the surface texture may be formed on the face after the face is formed, such as by milling, sandblasting, shot peening, or any other method known in the art.

Other parameters may be varied systematically through the set, such as toe height, top angle, sole thickness, material alloy and/or hardness, insert type and hardness, face thickness and/or material, and coefficient of restitution. Also, the depth of the center of gravity may also be varied through the set, as the depth of the center of gravity affects flight performance as disclosed in U.S. Pat. No. 6,290,607, the disclosure of which is hereby incorporated by reference. Additionally, the all of the equations discussed herein are examples and may have any variation desirable for performance continuum throughout the set. In other words, the particular equations developed herein may be altered or adjusted so that a design parameter progresses in alternate ways than those described herein by adjusting the relationship between for example, the offset and the loft angle. The design tolerances discussed herein are preferences and may be adjusted to account for inter alia different materials and aesthetics.

While it is apparent that the illustrative embodiments of the invention disclosed herein fulfill the objectives stated above, it is appreciated that numerous modifications and other embodiments may be devised by those skilled in the art. Therefore, it will be understood that the appended claims are intended to cover all such modifications and embodiments, which would come within the spirit and scope of the present invention.

We claim:

1. A set of iron-type golf clubs comprising at least three clubs, wherein a surface roughness (SR) for each club is in accordance with $$SR=\alpha*(3.75\mu in/deg *LA-7.5\mu in)$$

wherein LA is a loft angle measured in degrees and wherein $\alpha$ is about 1.

2. The set of clubs according to claim 1, further comprising at least one dampened club which comprises a body comprising a hitting face, a hitting face insert is disposed in the hitting face, a rear face comprising a rear flange having a channel formed therewithin, a core configured to be inserted at least partially within the channel and in contact with the hitting face insert, and a dampening element disposed between the core and the hitting face insert.

3. The set of clubs according to claim 2, wherein the dampened club is a long iron.

4. The set of clubs according to claim 1, wherein the clubs systematically transition from channel back clubs in long irons of the set to cavity back clubs in short irons of the set.

5. The set of clubs of claim 1, wherein at least one club includes an oversized club head.

* * * * *